US007404558B2

(12) United States Patent
Kanome

(10) Patent No.: US 7,404,558 B2
(45) Date of Patent: Jul. 29, 2008

(54) SHEET SUPPLYING DEVICE AND SHEET PROCESSING DEVICE USING DETECTING LEVER

(75) Inventor: Yuji Kanome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/447,859

(22) Filed: Jun. 7, 2006

(65) Prior Publication Data

US 2006/0284362 A1 Dec. 21, 2006

(30) Foreign Application Priority Data

Jun. 7, 2005 (JP) ..... 2005-166508

(51) Int. Cl.
*B65H 7/02* (2006.01)

(52) U.S. Cl. ..... 271/258.05; 271/265.01; 271/258.01; 400/625

(58) Field of Classification Search ..... 271/258.01, 271/258.05, 259, 265.01, 265.02
See application file for complete search history.

(56) References Cited

U.S. PATENT DOCUMENTS 2,215,091 A * 9/1940 Adatte et al. ..... 271/265.02
5,820,282 A * 10/1998 Nakai ..... 400/642
5,882,130 A * 3/1999 Kumazaki et al. ..... 400/642
5,993,094 A * 11/1999 Lee ..... 400/625
6,095,703 A * 8/2000 Tanaka et al. ..... 400/582
6,102,392 A * 8/2000 Gleichauf et al. ..... 271/265.02
6,457,888 B1 * 10/2002 Matsumoto ..... 400/625
7,020,429 B2 * 3/2006 Hamada et al. ..... 399/367
7,070,181 B2 * 7/2006 Ueng et al. ..... 271/258.01
7,182,336 B2 * 2/2007 Fukushima et al. .... 271/265.01
7,182,337 B2 * 2/2007 Sasai et al. ..... 271/265.01
7,187,901 B2 * 3/2007 Ohashi ..... 399/388

FOREIGN PATENT DOCUMENTS

JP 01122851 A * 5/1989
JP 04116043 A * 4/1992

* cited by examiner

*Primary Examiner*—Patrick Mackey
*Assistant Examiner*—Gerald W McClain
(74) *Attorney, Agent, or Firm*—Fitzpatrick, Cella, Harper & Scinto

(57) ABSTRACT

A sheet supplying device has a sheet delivering roller for delivering sheets one by one; a feeding roller for feeding the sheet delivered by the sheet delivering roller; a pinch roller urged by the feeding roller to be rotated by the feeding roller; a detecting lever swingable by being contacted by a leading of the sheet delivered by the sheet delivering roller; and a sensor for detecting the swing motion of the detecting lever. An area of said detecting lever to which the leading end of the sheet is contactable is such a curved surface that a distance from a nip between the feeding roller and the pinch roller is substantially constant.

7 Claims, 8 Drawing Sheets

SHEET SUPPLYING DEVICE AND SHEET PROCESSING DEVICE USING DETECTING LEVER

BACKGROUND OF THE INVENTION

The present invention relates to a sheet supplying device including delivering means for delivering sheets one by one and feeding means for feeding the delivered sheet to a sheet processing portion, and relates to a sheet processing device using the sheet supplying device.

A sheet processing device for processing the supplied sheet in a sheet processing portion such as an image forming station is used in a recording device (printer) which is an information output device of a personal computer or the like, and the sheet processing device includes delivering means for delivering the sheets one by one and feeding means for feeding the delivered sheets to the processing portion.

Conventionally, sheet supplying devices for feeding the sheets one by one from a stack of sheets are widely known, and are used in printers, copying machines, facsimile machines and other recording devices. Generally, such a sheet supplying device comprises stacking means for stacking the sheets, delivering means for separating and delivering the stacked sheets one by one, and sheet detecting means for detecting a leading end or a trailing end of the delivered sheet, and feeding means for feeding the delivered sheet to the processing portion such as the image forming station or the like. The sheet detecting means includes an actuator (swing lever, for example) which is operated by abutment of the leading end of the delivered sheet thereto to block or open an optical path of a sensor (photo-interruptor), so that electrical signal of the sensor is rendered on and off in response to presence and absence of the sheet, respectively.

The separation and delivery of the sheet by the delivering means is ordinarily as follows. First, the sheet is singled out of the stack of sheets by a pick-up roller and a separating mechanism. Then, the leading end of the sheet is detected by the sheet detecting means. On the basis of the output of the sheet detecting means (leading end detection information), the delivering means delivers the sheet to the feeding means in a manner matching various delivery conditions. Thereafter, the feeding means feeds the sheet to the downstream, and feeds it through the sheet processing portion such as the image forming station or the like. During the feeding, a trailing end of the sheet is detected by sheet detecting means (sheet end detecting means), and the sheet is further fed by a predetermined distance.

FIG. 6 is a longitudinal sectional view of a sheet supplying device of a conventional recording device. FIG. 7 is a longitudinal sectional view of the sheet supplying device of FIG. 6 in a state at an instance of detecting the leading end of the sheet. FIG. 8 is a partial enlarged major part longitudinal sectional view of a major part of the sheet supplying device of FIG. 6. In FIGS. 6 and 7, the sheet P delivered by an unshown delivering means is fed through a feeding passageway T defined as a predetermined gap by a pinch roller holder 305 and a platen 303. In the feeding passageway, there is provided a detecting lever 307 as if it blocks the passing of the sheet. A leading end of the delivered sheet P contacts (abuts) to the detecting lever 307 (actuator) to rotate the detecting lever, which blocks or opens, by the other end portion thereof, the optical path of the sensor 308 in the form of a photo-interruptor mounted on the electrical substrate 102. The position of the leading end of the sheet is detected by changes of the output signal of the photo-interruptor.

More particularly, the delivered sheet P is caught by a nip N provided by the feeding roller 302 and the pinch roller 304 contacted thereto. The position of the nip N is taken as a reference position, and the position of the leading end of the sheet P is determined on the basis of the design positional relations among the detecting lever 307, the sensor 308 and the nip. When a distance between the nip N and a sheet contact position of the detecting lever at the instance of actuation of the photo-interruptor 308 by rotation of the detecting lever 307 of the actuator about the pivot 307*c*, is L, the position of the leading end of the sheet P is upstream of the nip N by the distance L at the instance when the photo-interruptor 308 is rendered on (open). When the sheet P is fed through the feeding passageway T defined by the platen 303 and the pinch roller holder 305, the sheet is guided along the platen 303 defining the lower surface of the feeding passageway T because of the influence of the gravity and the influence of the rigidity of the sheet.

In FIG. 7, the time when the detecting lever 307 crosses the optical axis of the photo-interruptor (sensor) (when the optical path is changed from the blocked state to the open state) is the time when the position of the leading end of the sheet P is detected. The position of the leading end of the sheet known to the main assembly of the apparatus is the position which is upstream of the nip N by the distance L. As shown in FIGS. 7 and 8, the sheet leading end contactable region 307*b* of the detecting lever 307 to which the leading end of the sheet is abuttable upon the detection is inclined from an upstream side toward a downstream side with respect to a downward direction.

With this structure, when the sheet shown by a solid line P1 in FIG. 8 is fed along the platen 303 which is the lower end surface of the feeding passageway, the situation is the same as that of the design, and therefore, the position of the leading end of the sheet can be detected correctly. However, the leading end portion of the sheet may be curled upwardly, or the leading end portion of the sheet may be waved under a high humidity ambience. In such a case, as shown by a broken line P2 in FIG. 8, the sheet may be fed along the pinch roller holder 305 defining the upper end surface of the feeding passageway, and therefore, a deviation arises between the position of the leading end of the sheet sensed by the device and the actual position of the leading end of the sheet, the deviation being $\delta L = M - L$. If this arises, the top position of the image formation may be inaccurate, or the top margin may be deviated from the intended margin, with the result of deterioration of the accuracy of the sheet processing such as image formation or the like on the sheet.

In some sheet supplying devices, the sheet is fed into the image forming station 401 without correcting obliqueness of the delivered sheet by the nip N between the feeding roller 302 and the pinch roller 304 after the leading end of the sheet is detected, and in the other supplying device, the sheet is fed into the image forming station with the obliqueness of the delivered sheet corrected. In the image forming station 401, there is provided a carriage portion 403 including a carriage 404 reciprocable in the main scan direction along a guiding shaft 405 and a recording head 402 carried on the carriage, and the image formation is effected on the sheet P by driving the recording head on the basis of image information. The sheet on which the image has been formed is discharged in the direction indicated by an arrow A by a sheet discharge portion 501 constituted by sheet discharging rollers 502, 503, spurs 504, 505 and so on.

In an example of obliqueness correcting mechanism, the leading edge of the sheet is abutted to the nip where the feeding means 302, 304 are not rotated, and the sheet is pushed by a predetermined degree, 3 mm, for example, thus forming a loop of the sheet to make the entirety of the leading edge of the sheet abuts the nip. Therefore, when the obliqueness correction is not carried out, the above-discussed deviation δL of the leading end position of the sheet results in the top margin deviation as it is in the print. On the other hand, when the obliqueness correction is carried out, the actual sheet pushing degree for the correction is deviated by δL from the proper degree of pushing, and therefore, the loop degree may be improper, resulting in deterioration of the obliqueness correction performance.

CROSS-REFERENCE TO RELATED APPLICATIONS

This Application claims priority from Japanese Application No. 166508/2005, filed Jun. 7, 2005.

BRIEF SUMMARY OF THE INVENTION

Accordingly, it is a principal object of the present invention to provide an sheet supplying device and a sheet processing device wherein the position of the leading end of the sheet can be accurately detected even when the path (track) of the sheet movement in the feeding passageway defined as a predetermined gap is deviated in the direction of height of the passageway (across the passageway).

According to an aspect of the present invention, there is provided a sheet supplying device comprising sheet delivering means for delivering sheets one by one; feeding means for feeding the sheet delivered by said sheet delivering means; and detecting means, disposed between said sheet delivering means and said feeding means, for detecting a leading end of the sheet, wherein when said detecting means detects the leading end of the sheet, a distance between a feeding reference position where said feeding means nips the sheet and the leading end of the sheet is constant irrespective of a path of the sheet delivered to said detecting means.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
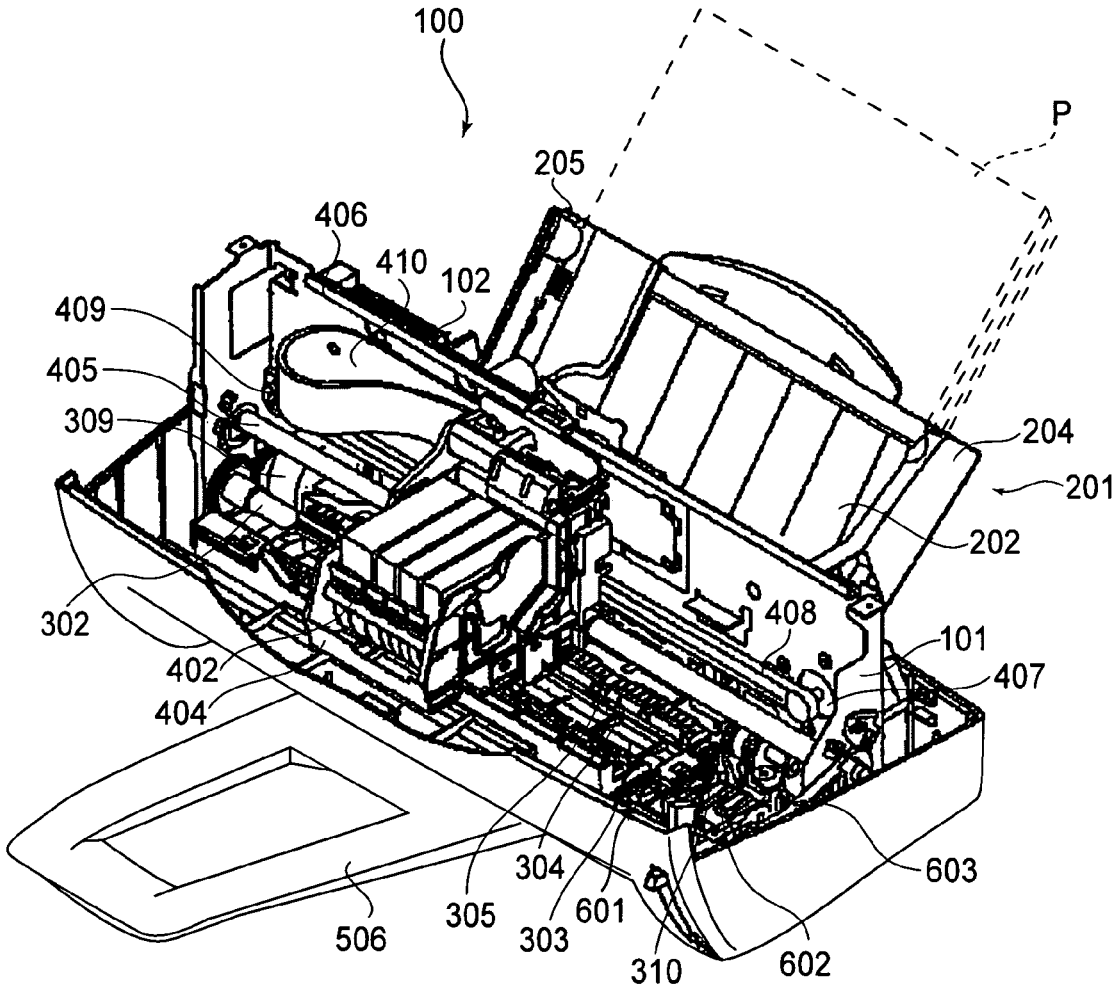
FIG. 1 is a perspective view of a general arrangement of a recording device as a sheet processing device according to an embodiment of the present invention.

The embodiments of the present invention will be described in conjunction with the accompanying drawings. The same reference numerals are assigned to the elements having the corresponding functions in the following description. In this specification, "recording" includes formation of an image, a pattern or the like, irrespective of whether it is visible or not by human visual sense, and not limited to formation of information having a sense, such as letters, characters or figures. In this specification, "sheet" is not limited to an ordinary sheet of paper but includes textile, plastic resin material, film, metal plate, glass, ceramic, wood, leather and the like, and any sheet material which can be subjected to an image formation process, reading process, exposure process, machining process. In this specification, "ink" includes liquid which can form an image, a pattern or the like on the "sheet", the liquid which can be used for machining the "sheet" and the liquid which can be used for processing the ink for coagullation or insolubilization of the coloring material contained in the ink and which can be applied on the "sheet"

Figure 2:
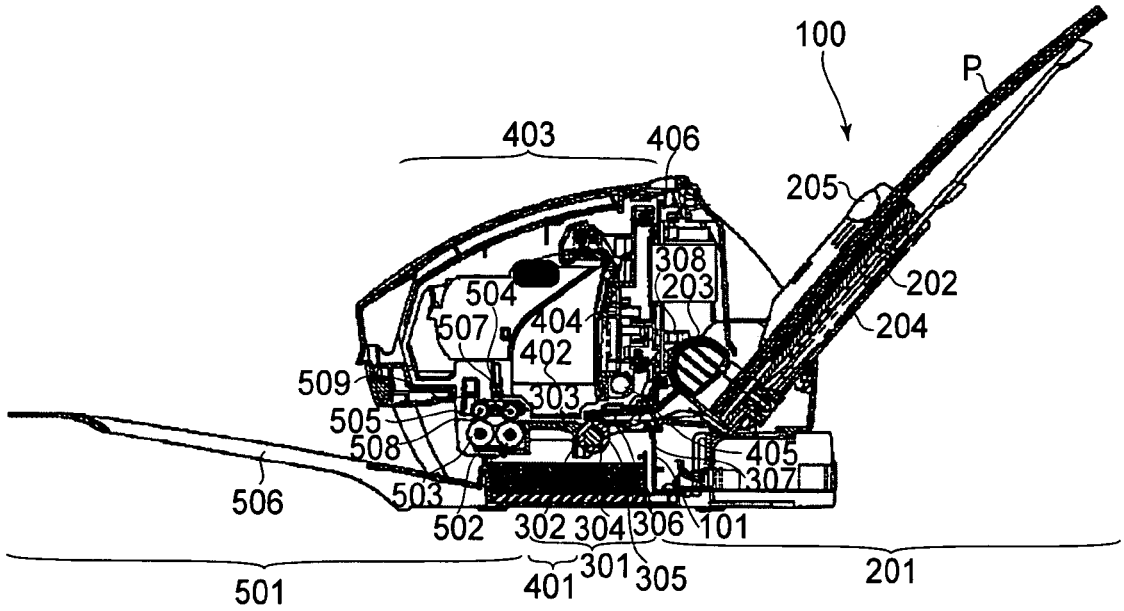
FIG. 2 is a longitudinal sectional view of a recording device of FIG. 1.

In this embodiment, the sheet supplying device of the present invention is a part of the sheet processing device which is a recording device of an ink jet type. FIG. 1 is a perspective view illustrating a general arrangement of the recording device of this embodiment, and FIG. 2 is a longitudinal sectional view of the recording device of FIG. 1. In FIGS. 1 and 2, designated by reference numeral 100 is a recording device of an ink jet type, which comprises a sheet delivering portion 201, a feeding portion 301, an image forming station 401, a sheet discharge portion 501 and a cleaning portion 601.

The sheet delivering portion 201 comprises a pressure plate 202 which supports a stack of sheets P, a sheet delivering roller 203 for delivering the sheet, and a base 204 supporting the pressure plate 202 and the sheet delivering roller 203. The pressure plate 202 is provided with side guides 205 for limiting the stacked sheets in the widthwise direction, the side guides 205 being movable in the widthwise direction. The sheet delivering portion 201 is provided with unshown delivery releasing means which functions to move the pressure plate 202 toward and away from the sheet delivering roller 203. The sheet delivering roller 203 cooperates with an unshown separating mechanism such as a separation roller to deliver the sheets one by one.

Figure 3:
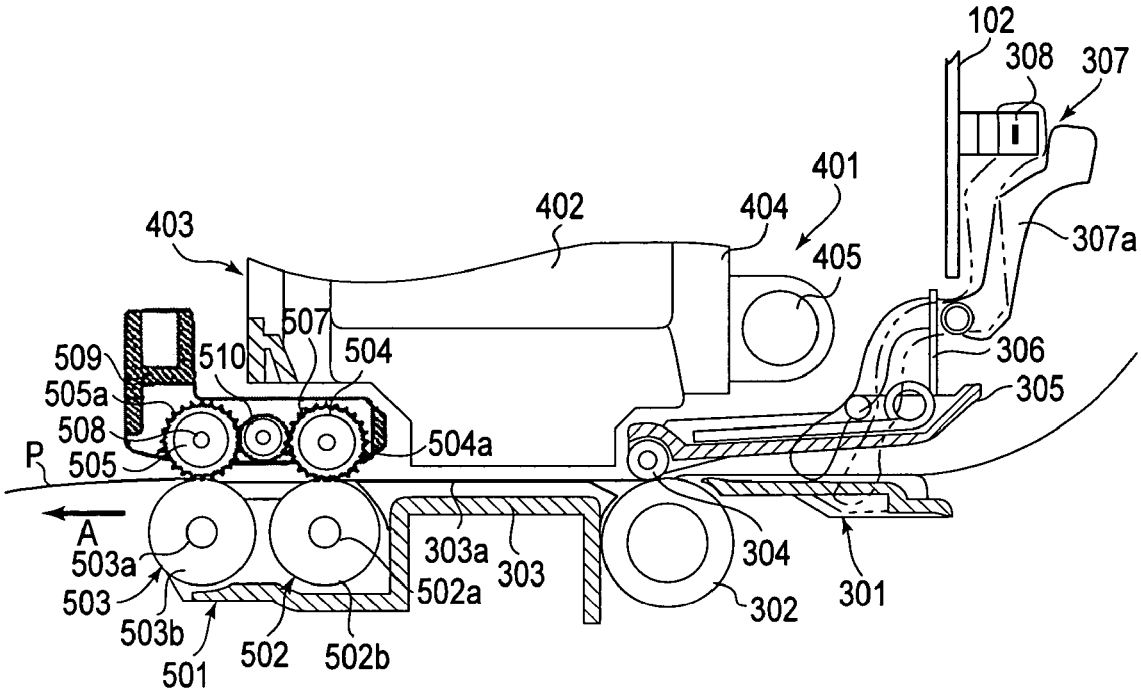
FIG. 3 is a longitudinal sectional view of a feeding portion, a sheet discharge portion and a carriage portion of a recording device as a sheet processing device according to an embodiment of the present invention.
Figure 4:
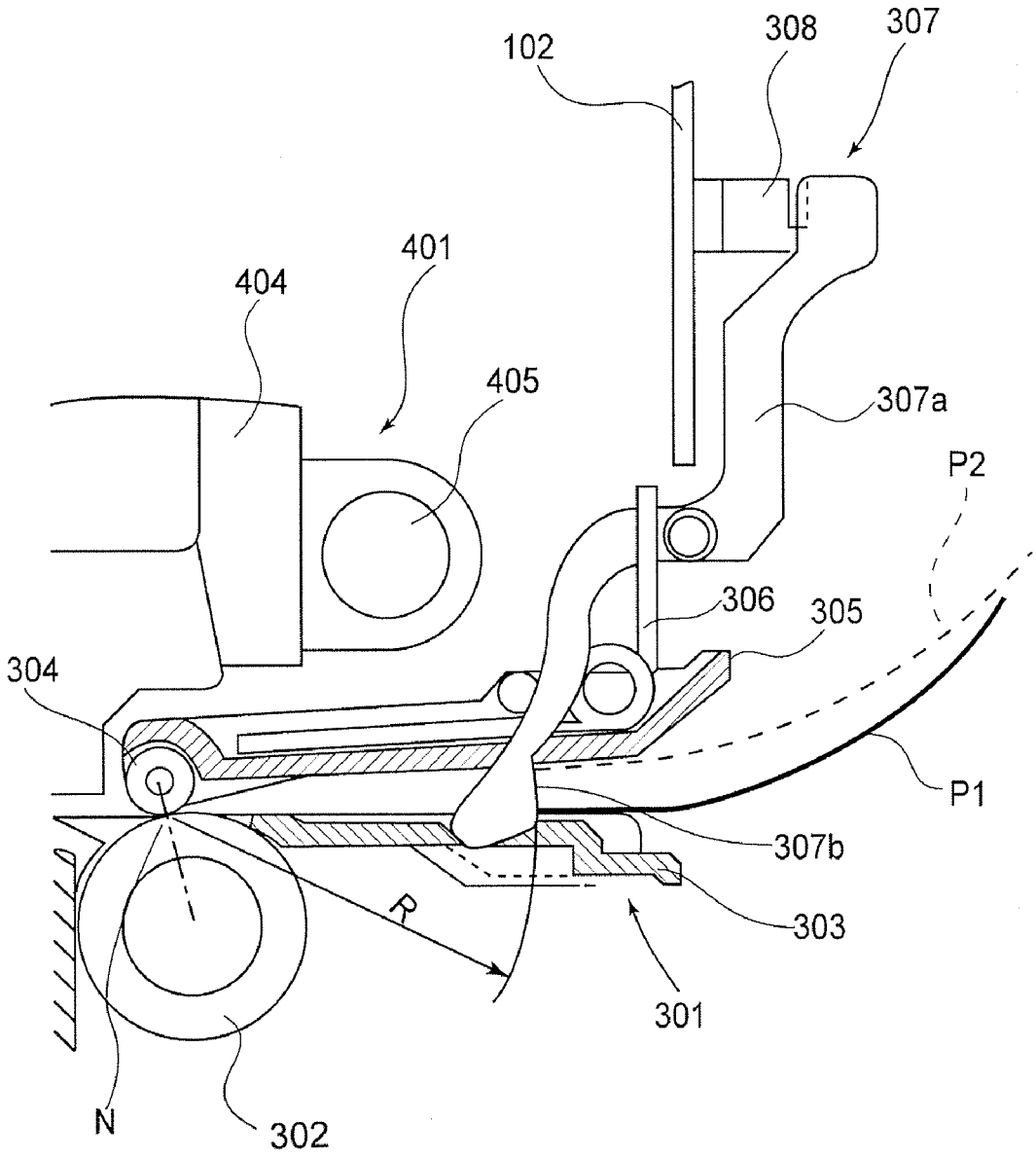
FIG. 4 is a longitudinal sectional view of a sheet supplying device of a recording device as a sheet processing device according to an embodiment of the present invention, wherein the position of the leading end of the sheet is being detected.
Figure 5:
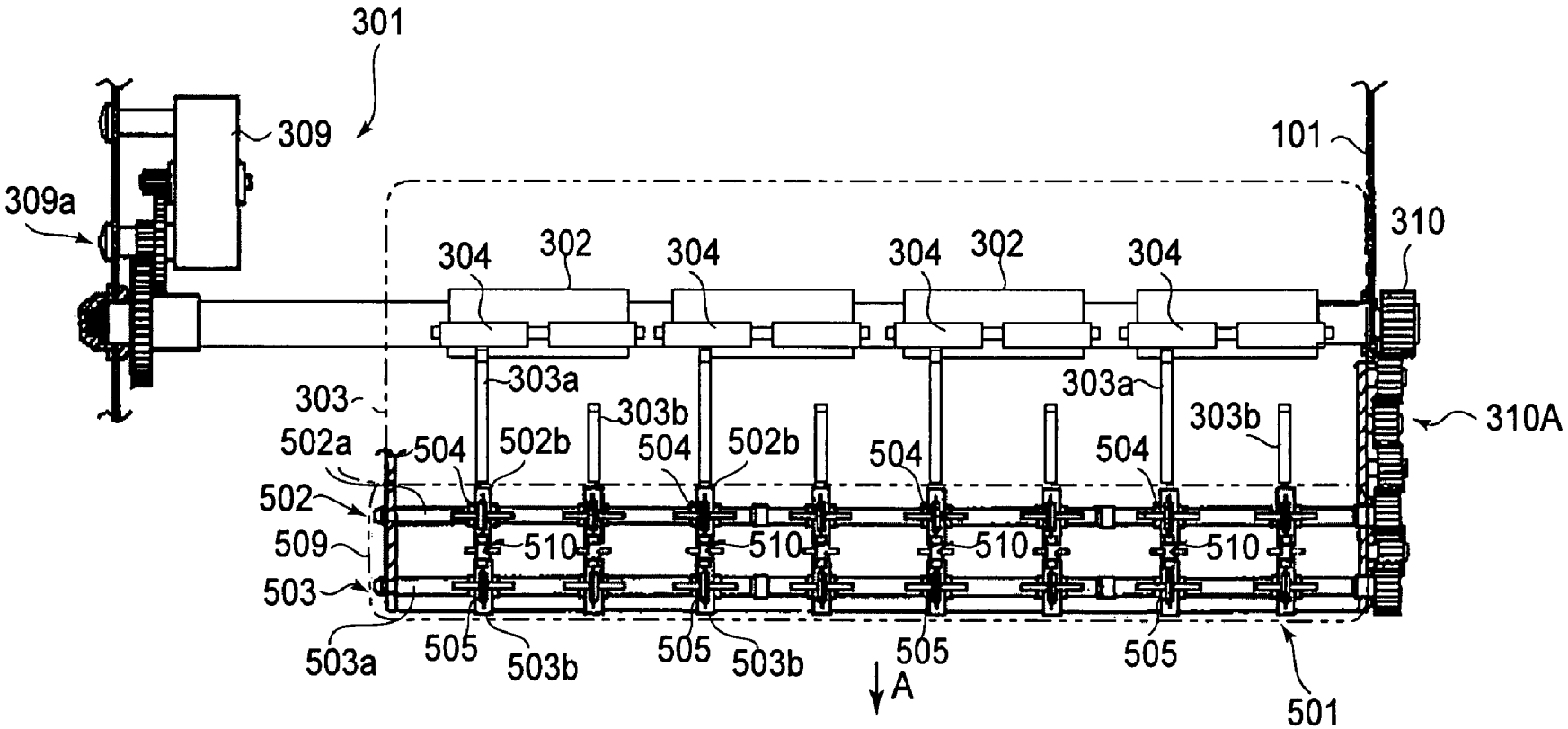
FIG. 5 is a top plan view of a feeding portion and a sheet discharge portion of the recording device of FIGS. 1 and 2.
Figure 6:
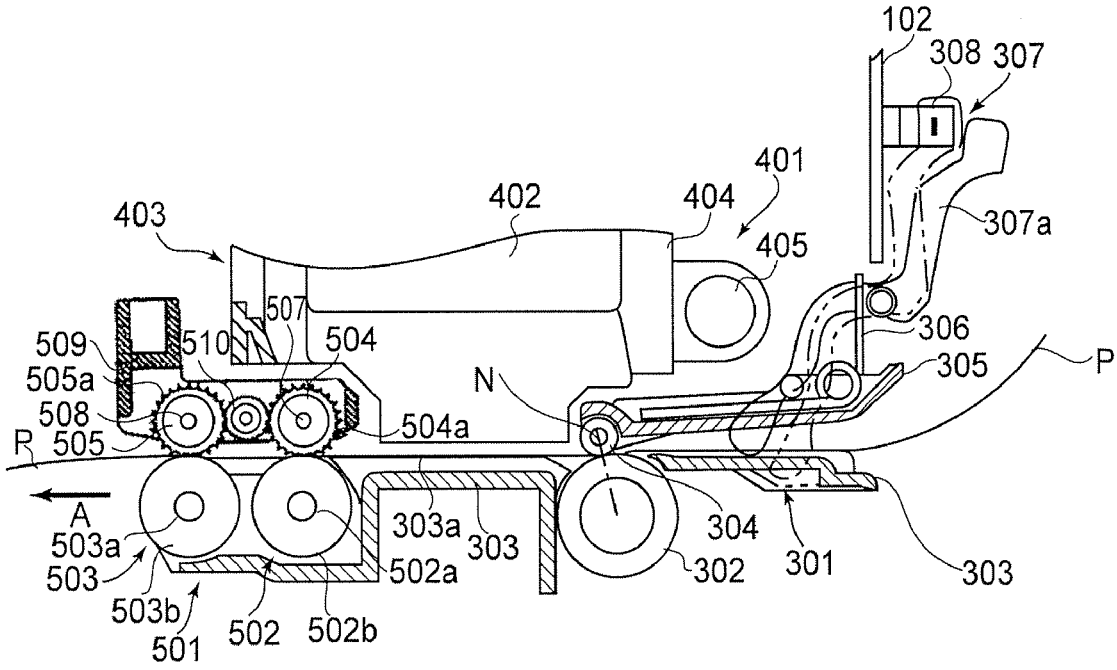
FIG.6 PRIOR ART
FIG. 6 is a longitudinal sectional view of a sheet supplying device of a conventional recording device.
Figure 7:
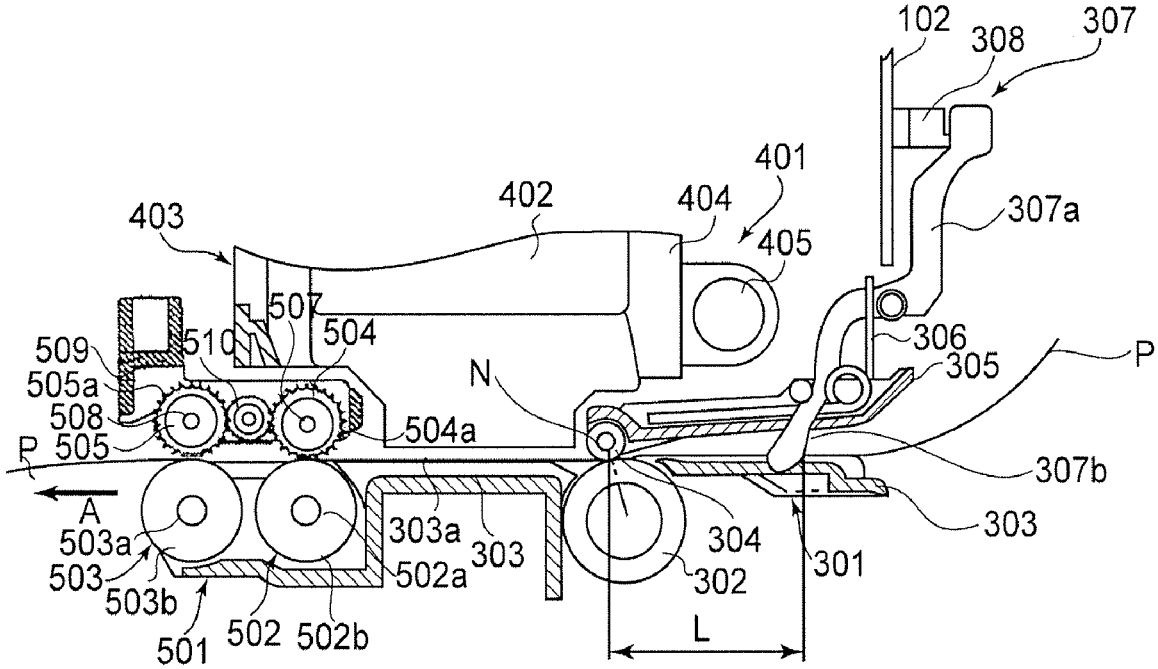
FIG. 7 PRIOR ART
FIG. 7 is a longitudinal sectional view of the sheet supplying device of FIG. 6 wherein a leading end of the sheet is being detected.
Figure 8:
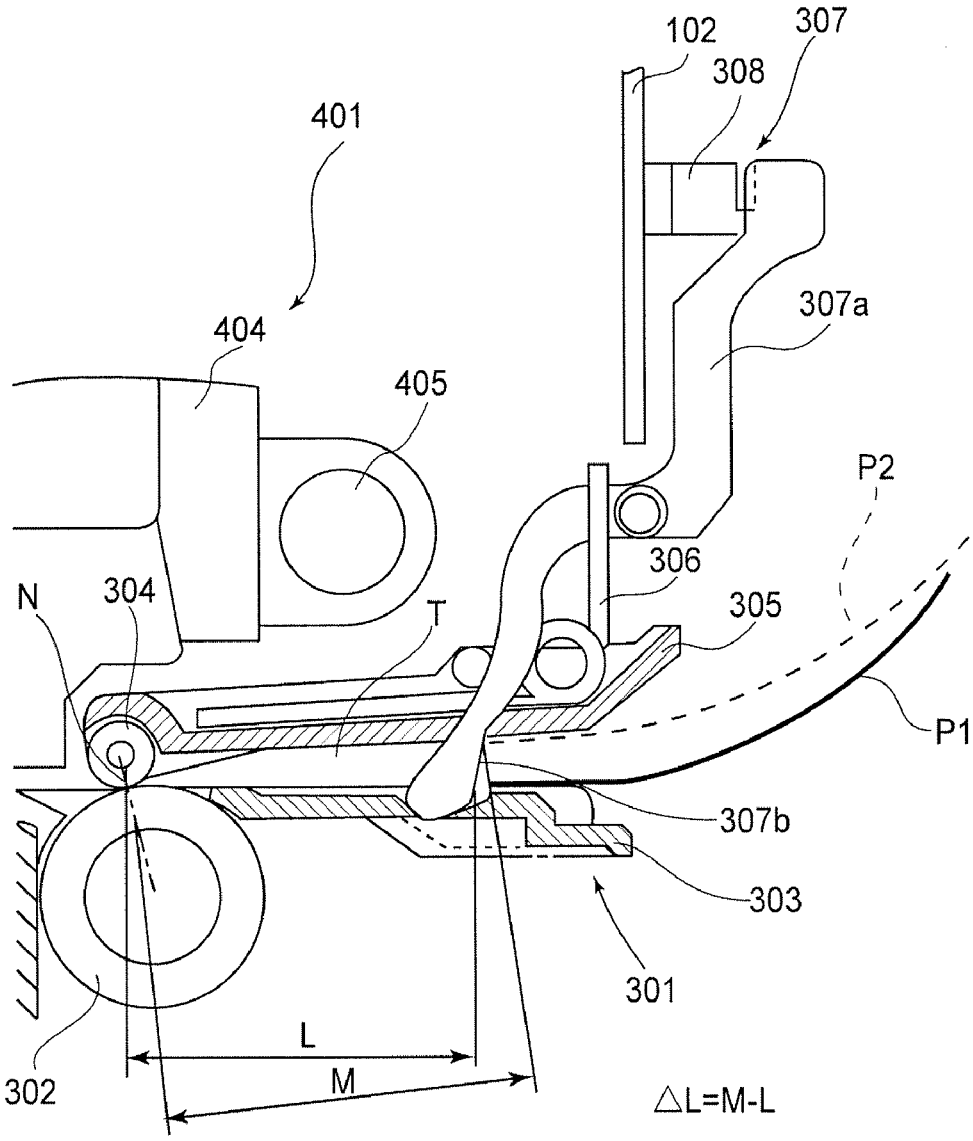
FIG.8 PRIOR ART
FIG. 8 is an enlarged longitudinal sectional view of a major part of the sheet supplying device of FIG. 6.

FIG. 3 is a longitudinal sectional view of a feeding portion, a sheet discharge portion and a carriage portion of a recording device as a sheet processing device according to the embodiment of the present invention. FIG. 4 is a longitudinal sectional view of a sheet supplying device of a recording device as a sheet processing device according to the embodiment of the present invention, wherein the position of the leading end of the sheet is being detected. FIG. 5 is a top plan view of a feeding portion and a sheet discharge portion of the recording device of FIGS. 1 and 2. As shown in FIG. 1-FIG. 5, the feeding portion 301 comprising feeding means including a feeding roller 302 for feeding the sheet P and a pinch roller 304 cooperative therewith. The feeding portion further includes a platen 303 having ribs 303*a*, 303*b* for setting a gap between the sheet and the recording head 402 (FIG. 5), and includes a detecting lever 307 constituting sheet detecting means for detecting the position of the leading end of the delivered sheet. The detecting lever 307 is capable of detecting a position of the trailing end of the sheet.

The driving force from the feeding motor 309 is transmitted to the feeding roller 302 through a gear train 309*a* with speed reduction. Against the feeding roller 302, a rotatable pinch roller 304 is pressed, and the sheet is fed by a friction feeding force produced therebetween. The pinch roller 304 is supported by a pinch roller holder 305 which is urged toward the feeding roller 302 by a pinch roller spring 306. The platen 303 and the pinch roller holder 305 are extended to a neighborhood of an inlet of the feeding portion 301 to which the sheet P is delivered, and they form a feeding passageway T having a predetermined gap for guiding the sheet toward upstream with respect to the feeding direction of the feeding means.

The sheet detecting means for detecting the position of the leading end of the sheet in the feeding passageway T comprises a detecting lever and a sensor 308 in the form of a photo-interruptor or the like. The detecting lever 307 constituting the sheet detecting means is swingably supported, and it is swung by the passing of the sheet. The detecting lever functions as an actuator operated by the leading end of the sheet, and the sensor 308 detects the operation of the actuator. The photo-interruptor 308 generates an electrical signal in response to blocking and opening of the optical path (optical axis) caused by the position change of the other end portion of the detecting lever 307. The image forming station 401 is disposed downstream of the feeding roller 302 with respect to the feeding direction. The image forming station comprises a carriage portion 403 including a recording head 402 for forming an image in accordance with the image information and a carriage 404 for detachably supporting the recording head 402.

The carriage 404 is supported by a guiding shaft 405 and a guiding rail 406, for reciprocation in a direction crossing with the feeding direction (main scan direction). The carriage 404 is supported such that gap between the recording head 402 and the sheet can be adjusted by adjusting the position changeable by swing about the guiding shaft 405. The guiding shaft 405 is mounted on the chassis 101, and the guiding rail 406 is provided by bending an upper portion of the chassis 101 into a configuration having a Z-shaped cross-section. The carriage 404 is moved rectilinearly by a carriage motor 407 (FIG. 1) mounted on the chassis 101 through a timing belt 408 (FIG. 1). The timing belt 408 is stretched by an idle pulley 409. To the carriage 404, a flexible cable 410 for transmitting a signal to the recording head 402 from the electrical substrate 102 is connected.

The recording device (sheet processing device) of this embodiment is an ink jet recording apparatus which ejects imagewisely ink droplets from a recording head in accordance with the image information to form an image on a sheet. The surface (ejection side surface) of the recording head 402 facing the sheet is provided with a plurality of ejection outlet, and each of the ink flow paths connecting to the associated ejection outlet is provided with an electrothermal transducer in the form of a heater or the like for generating thermal energy for ink ejection. By selectively actuating the electrothermal transducers in accordance with the image information, film boiling is produced in the ink contained in the ink path by the thermal energy applied by the electrothermal transducer. The ink droplet is ejected through the ejection outlet by the pressure change caused by growth or contraction of a bubble created by the film boiling.

In FIG. 1-FIG. 5, a sheet discharge portion 501 is provided at a position downstream of the image forming station 401. The sheet discharge portion 501 functions to discharge the sheet having been subjected to the image forming operation, and also functions to stabilize the sheet during the image formation. The sheet discharge portion includes sheet discharging rollers 502, 503 extending in parallel with the feeding roller 302, driven spurs 504, 505 for pressing the sheet to the sheet discharging roller, a spur base 509 for rotatably supporting the spurs 504, 505, and a sheet discharge tray 506 for stacking the sheets discharged thereto. The sheet discharging rollers 502, 503 are supported by a supporting portion of the platen 303. The sheet discharging rollers are driven in synchronism with the feeding roller 302 through a gear train 310A (FIG. 5) by a driving output gear 310 (FIG. 5) provided at one end of the feeding roller 302.

The spurs 504, 505 are provided with sharp projections on the outer peripheries thereof to suppress occurrences of dimples and ink trace on unfixed ink existing immediately after image formation, and are driven by the sheet P which is pressed thereby to rubber portions of the sheet discharging rollers 502, 593. The spurs 504, 505 are provided at predetermined intervals in the widthwise direction of the sheet, and the spurs are supported by respective spring shafts for movement in the direction of thickness of the sheet, independently from each other. The spur base 509 is provided with a spur cleaner 510 for removing the ink, the dust and so on deposited on each of the spurs by being driven by the spurs 504, 505 contacted thereto.

The base portion of the sheet discharge tray 506 (FIGS. 1 and 2) is supported on an outer casing portion of the apparatus. A mounting portion of the base portion of the sheet discharge tray is disposed lower than the downstream sheet discharging roller 503 by a predetermined height such that plurality of the discharged sheets P can be stacked thereon, and the sheet discharge tray is inclined upward toward the leading end thereof. The feeding roller 302, the platen 303, the sheet discharging rollers 502, 503 and the leading end portion of the sheet discharge tray 506 are substantially at the same level, so that sheet P is supported in a substantially flat plane or is supported in such a concave plane that back side of the sheet is slightly urged to the platen 303. By doing so, the undesirable rising of the sheet P in the image forming station 401 is prevented.

Referring back to FIG. 1, the cleaning portion 601 functions to clean the recording head 402 to maintain and/or recover the ink ejection performance and is ordinarily disposed at a home position of the carriage 404 (recording head 402). The cleaning portion (refreshing process portion) comprises a refreshing process means such as capping means 602 for covering the ejection side surface of the recording head, a suction pump (unshown) for refreshing the ink in the recording head by suction of the ink out through the ejection outlets while the capping means 602 caps the ejection outlets, and wiping means for wiping and cleaning the ejection side surface.

The cleaning portion of this embodiment is provided with drive switching means for switching the driving force from the feeding roller 302 to drive selectively the delivering portion 201 or the suction pump. The switching means includes a switching arm 603 movable in interrelation with the carriage 404, and the switching arm is capable of providing, on the basis of the position of the carriage, a state in which the driving force is transmitted to either one of the delivering portion 201 and the suction pump and a state in which the driving force is transmitted to neither of them.

The recording operation of the recording device 100 having the structures described in the foregoing will be described. The sheet P stacked inclinedly on the pressure plate 202 is contacted to the sheet delivering roller 203, and the sheet delivering roller 203 is rotated, by which the topmost sheet is delivered, and only the topmost sheet is delivered by cooperation with the separating means to the feeding portion 301 substantially in the horizontal direction. The separating means may be in the form of a known separation roller (retarding roller) or a separation sheet which is cooperative with the sheet delivering roller 203, wherein the use is made with a difference in the friction coefficient between the sheet and the separating means to cause the second and subsequent sheets to remain. If necessary, returning means such as a rotation lever for returning, each time the sheet delivering roller 203 rotates, the second and subsequent sheets unintentionally delivered, is additionally usable.

The delivered sheet is fed toward the nip N formed between the feeding roller 302 and the pinch roller 304 through a feeding passageway T defined as a predetermined gap by the platen 303 and the pinch roller holder 305. Across the feeding passageway T, the detecting lever 307 is extended. The detecting lever 307 is rotatable about the pivot 307*c*. When the sheet P is fed toward the nip N, the leading end of the sheet abuts one end portion of the detecting lever 307 to rotate the detecting lever (actuator), by which the other end portion blocks and opens the optical path of the photo-interruptor 308 carried on the electrical substrate 102. The position of the leading end of the sheet is detected by changes of the output signal of the photo-interruptor.

In other words, with the shown structures, the sheet detecting means is constituted by the detecting lever 307 and the photo-interruptor. The sheet detecting means is capable of detecting the trailing end of the sheet as well as the leading end thereof. FIG. 4 shows a state in which the sheet detecting means detects the position of the leading end of the sheet.

With the structure described with FIG. 1-FIG. 5, the sheet processing device (recording device) comprises the sheet supplying device, and the sheet supplying device includes delivering means for delivering the sheet P one by one, feeding means (feeding roller 302 and pinch roller 304 and so on) for feeding the delivered sheet to the sheet processing portion and sheet detecting means (detecting lever 307, sensor 308 and so on), disposed between the delivering means and the feeding means, for detecting the leading end of the sheet The sheet supplying device is constructed such that when the sheet detecting means detects the leading end of the delivered sheet, the distance between the leading end of the sheet and the feeding reference position where the feeding means nips the sheet is constant irrespective of a track of the delivered sheet along which the sheet moves to the sheet detecting means. As shown in FIG. 4, when the sheet detecting means detects the leading end of the sheet P delivered along the feeding passageway T, the distance R (FIG. 4) between the leading end of the detected sheet P and the feeding reference position which is the position of the nip N where the feeding means 302, 304 nips the sheet is constant irrespective of the track (Pl, P2, for example, in FIG. 4) of the sheet along which the sheet moves in the feeding passageway T.

More particularly, the sheet detecting means for detecting the position of the leading end of the sheet P in the feeding passageway T between the delivering means and the feeding means has the detecting lever 307 moved by the leading end of the sheet and the sensor 308 for detecting the movement of the detecting lever. When the leading end of the sheet P is contacted or abutted to the detecting lever 307, and the sensor 308 detects the leading end of the sheet, and any point on substantially the entire region or area 307*b* (of the detecting lever 307) to which the leading end of the sheet is abuttable is away from the feeding reference position N by the same distance R. The entire range, in the direction of height of the feeding passageway T, of the region 307*b* contactable to the leading end of the sheet is exposed toward the upstream with respect to the feeding direction. The region 307*b* is the entirety of the region of the detecting lever 307 that is abuttable or contactable by the leading end of the delivered sheet P, and the distance (distance R in FIG. 4) between any point on the region and the feeding reference position is the same.

According to the sheet supplying device of the embodiment of the present invention, when the detecting lever 307 detects the leading end of the sheet, the distance between the position of the leading end of the sheet and the feeding reference position (nip position) N is the constant (R), even if the sheet is delivered along the platen 303 as shown by P1 in FIG. 4, even if the sheet is delivered along the pinch roller holder 305 as shown by P2 in FIG. 4, and even if the sheet is delivered along any track between the P1 and P2. In response to the leading end position information of the sheet P, the sheet feeding operation is executed to the predetermined image formation position (ordinarily the sheet process position) in the predetermined sheet feeding mode (the sheet feeding speed, the inclination (obliqueness) correcting control).

Thus, on the basis of the result of accurate detection of the position of the leading end of the sheet P, the control of the subsequent operation such as the obliqueness correcting operation, the print start position controlling operation or the like, can be accurately carried out. Therefore, the inclination accuracy and the top margin accuracy in the image formation can be assured. In other words, even if the position of the sheet in the direction of height of the feeding passageway T is deviated, the position of the leading end of the sheet P can be accurately detected.

In an ordinary sheet processing device, when the feeding roller 302 and the pinch roller 304 catches the sheet P at the nip therebetween, the delivery releasing means of the sheet delivering portion 201 is actuated by which the pressure plate 202 is separated from the sheet delivering roller 203. When the sheet P is fed by the sheet supplying device into the feeding portion 301, and is further fed on the platen 303 by the feeding means 302, 304 to the predetermined line position for the image formation, the carriage motor 407 moves the carriage portion 403 to the starting position of image formation so as to face the recording head 402 to the image formation position. By actuating the recording head 402 in accordance with the image information from the electrical substrate 102, the ink is ejected to the sheet from the ejection outlets to form an image.

In this embodiment, by repeating the one line image formation a desired number times, the recording is effected on the entirety of the sheet. The sheet detecting means 307 is capable of detecting a trailing end position of the sheet P, and on the basis of the trailing end position calculated from the result of the detection, the recording can be effected accurately to the trailing end position. The sheet P having been subjected to the recording operation at the image forming station 401 is discharged in the direction of an arrow A (FIG. 3) by the sheet discharging means including the sheet discharging rollers 502, 503 and the spurs 504, 505 pressed thereto and driven thereby. And, the sheet is received by the sheet discharge tray 506.

According to the foregoing embodiment, the position of the leading end of the delivered sheet can be accurately detected irrespective of the ambient condition (humidity, temperature or the like) under which the sheet processing device such as a recording device is placed, and irrespective of the state (curling, waving, friction coefficient or the like) of the leading end of the sheet. With such a structure, the sheet obliqueness correction and/or the print start position control can be accurately performed, and therefore, a sheet supplying device and a sheet processing device such as recording device using the sheet supplying device can be provided wherein the sheet process accuracy such as the positional accuracy in the recording is improved.

In the foregoing embodiment, the present invention is implemented in a recording device having an image forming station and in a sheet supplying device therefor, but the present invention is not limited to such an embodiment, and is applicable with the same advantage effects to a sheet processing device having a sheet processing portion which is not an image forming station. In the foregoing embodiment, the present invention is implemented in a serial type recording device wherein the recording head is carried on a carriage, but the present invention is not limited to such an embodiment and is similarly applicable with the same advantage effects to another type of recording device such as a line type recording device wherein scanning action is carried out only in the sub-scan direction.

Furthermore, in the foregoing embodiment, the recording system is an ink jet type, but the present invention is not limited to such an embodiment and is applicable with the same advantageous effects to various types of recording device such as a laser beam type device, a thermal transfer type device, a thermosensitive recording type device, a wire dot type device. When the present invention is used in an ink jet recording apparatus, it is applicable to an apparatus using one recording head, to an apparatus using a plurality of recording heads correspondingly to the different colors of the ink, to an apparatus using a plurality of recording heads for the same color but low density ink, and to an apparatus in the form of a combination of these apparatuses.

As described in the foregoing, according to the embodiments of the present invention, when the leading end of the delivered sheet is detected by the sheet detecting means, the distance between the leading end of the sheet and the feeding reference position where the sheet is nipped by the feeding means is constant irrespective of the track of the delivered sheet to the sheet detecting means. Therefore, a sheet supplying device and a sheet processing device is provided wherein the position of the leading end of the sheet can be-accurately detected even if the track of the sheet in the sheet is deviated from the design position in the direction of height of the sheet passageway defined as a gap having a predetermined height.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 166508/2005 filed Jun. 7, 2005 which is hereby incorporated by reference.

What is claimed is:

1. A sheet supplying device comprising:

a sheet delivering roller for delivering sheets one by one;

a sheet feeding roller for feeding the sheet delivered by said sheet delivering roller;

a pinch roller urged by said feeding roller to be rotated by said feeding roller;

a detecting lever swingable by being contacted by a leading end of the sheet delivered by said sheet delivering roller; and a sensor for detecting the swing motion of said detecting lever;

wherein an area of said detecting lever to which the leading end of the sheet is contactable is such a curved surface that a distance from a nip between said feeding roller and said pinch roller to the area of said detecting lever is substantially constant;

wherein the curved surface has a finite radius.

2. A sheet supply device according to claim 1, further comprising a platen rotatably supporting said feeding roller, a pinch roller holder rotatably supporting said pinch roller, wherein said detecting lever is contacted by the sheet which is being fed between said platen and said pinch roller holder.

3. A sheet supply device according to claim 2, wherein said detecting lever has a center of the swing motion at a pinch roller holder side with respect to a feeding path for the sheet.

4. A recording device comprising:

a recording station for effecting recording on a sheet by a recording unit;

a sheet delivering roller for delivering sheets one by one;

a feeding roller for feeding the sheet delivered by said sheet delivering roller toward said recording station;

a pinch roller urged by said feeding roller to be rotated by said feeding roller;

a detecting lever swingable by being contacted by a leading end of the sheet delivered by said sheet delivering roller; and a sensor for detecting the swing motion of said detecting lever;

wherein an area of said detecting lever to which the leading end of the sheet is contactable is such a curved surface that a distance from a nip between said feeding roller and said pinch roller to the area of said detecting lever is substantially constant;

wherein the curved surface has a finite radius.

5. A recording device according to claim 4, further comprising a platen for supporting the sheet at a position opposed to said recording means, a pinch roller holder for rotatable supporting said pinch roller, wherein said detecting lever is contacted by the sheet which is being fed between said platen and said pinch roller holder.

6. A recording device according to claim 5, wherein said detecting lever has a center of the swing motion at a pinch roller holder side with respect to a feeding path for the sheet.

7. A recording device according to claim 4, wherein an inclination of the sheet is corrected by abutting the leading end of the sheet to the nip between said feeding roller and said pinch roller.

* * * * *

UNITED STATES PATENT AND TRADEMARK OFFICE

CERTIFICATE OF CORRECTION

PATENT NO. : 7,404,558 B2
APPLICATION NO. : 11/447859
DATED : July 29, 2008
INVENTOR(S) : Kanome It is certified that error appears in the above-identified patent and that said Letters Patent is hereby corrected as shown below:

ON THE TITLE PAGE:
In item "(56) References Cited," under "FOREIGN PATENT DOCUMENTS," the two listed documents: "JP 01122851 A * 5/1989
JP 04116043 A * 4/1992"
should read as follows:

-- JP 1-122851 * 5/1989
JP 4-116043 * 4/1992 --.

In item "(57) ABSTRACT," line 5, "leading of" should read -- leading end of --.

COLUMN 3:
Line 22, "an" should read -- a --.

COLUMN 4:
Line 23, "coagullation" should read -- coagulation --.
Line 25, "sheet" should read -- sheet. --.

COLUMN 5:
Line 51, "imagewisely" should read -- imagewise --.

COLUMN 7:
Line 41, "sheet" should read -- sheet. --.

COLUMN 9:
Line 41, "be-accurately" should read -- be accurately --.
Line 42, "sheet is" should read -- sheet supplying device is --.

UNITED STATES PATENT AND TRADEMARK OFFICE

CERTIFICATE OF CORRECTION

PATENT NO. : 7,404,558 B2
APPLICATION NO. : 11/447859
DATED : July 29, 2008
INVENTOR(S) : Kanome It is certified that error appears in the above-identified patent and that said Letters Patent is hereby corrected as shown below:

COLUMN 10:
Line 16, “supply” should read -- supplying --.
Line 21, “supply” should read -- supplying --.
Line 45, “rotatable” should read -- rotatably --.

Signed and Sealed this

Twentieth Day of January, 2009

JON W. DUDAS
*Director of the United States Patent and Trademark Office*